US006199413B1

(12) United States Patent
McDaid et al.

(10) Patent No.: US 6,199,413 B1
(45) Date of Patent: Mar. 13, 2001

(54) SECURITY LOCK FOR PORTABLE ARTICLES

(75) Inventors: Cornelius McDaid, Dorchester; William Berrocal, Worcester, both of MA (US); Peter Twarog, Hanover, NH (US); John D. Fiegener, Mendon, MA (US)

(73) Assignee: Kryptonite Corporation, Canton, MA (US)

( * ) Notice: Subject to any disclaimer, the term of this patent is extended or adjusted under 35 U.S.C. 154(b) by 0 days.

(21) Appl. No.: 09/404,103

(22) Filed: Sep. 23, 1999

(51) Int. Cl.[7] ..... E05B 69/00
(52) U.S. Cl. ..... 70/58; 70/14; 70/57; 248/551
(58) Field of Search ..... 70/14, 18, 19, 70/57, 58; 248/551–553; 361/681, 685, 686, 732

(56) References Cited

U.S. PATENT DOCUMENTS

| | | | |
|---|---|---|---|
| Re. 30,801 | 11/1981 | Gley | 24/221 K |
| D. 346,733 | 5/1994 | Carl et al. | D8/343 |
| 1,190,852 | 7/1916 | Bishop . | |
| 1,303,770 | 5/1919 | Carr . | |
| 3,872,555 | 3/1975 | Link et al. | 24/221 R |
| 3,909,888 | 10/1975 | Funston et al. | 241/221 R |
| 3,914,965 | 10/1975 | Paxton | 70/34 |
| 4,801,232 | 1/1989 | Hempel | 411/552 |
| 4,991,271 | 2/1991 | Bauer et al. | 24/590 |
| 5,002,418 | 3/1991 | McCown et al. | 403/24 |
| 5,117,661 | 6/1992 | Carl et al. | 70/14 |
| 5,327,752 | 7/1994 | Myers et al. | 70/58 |
| 5,381,685 | 1/1995 | Carl et al. | 70/78 |
| 5,493,878 | 2/1996 | Murray, Jr. et al. | 70/58 |
| 5,502,989 | 4/1996 | Murray, Jr. et al. | 70/58 |
| 5,687,592 * | 11/1997 | Penniman et al. | 70/58 X |
| 5,791,171 * | 8/1998 | Kelley | 70/57 X |
| 5,875,657 * | 3/1999 | Kelley | 70/18 |
| 5,907,962 * | 6/1999 | Smithson et al. | 70/58 |
| 5,913,907 | 6/1999 | Lee | 70/58 |
| 5,983,679 * | 11/1999 | Reyes | 70/58 |
| 5,987,937 * | 11/1999 | Lee | 70/58 X |
| 6,000,251 | 12/1999 | Murray, Jr. et al. | 70/58 |
| 6,000,252 | 12/1999 | Murray, Jr. et al. | 70/58 |
| 6,006,557 | 12/1999 | Carl et al. | 70/58 |
| 6,038,891 * | 3/2000 | Zeren et al. | 70/58 |
| 6,058,744 * | 5/2000 | Ling | 70/58 X |

FOREIGN PATENT DOCUMENTS

| | | | |
|---|---|---|---|
| 1557208 | 12/1979 | (GB) | E05B/65/12 |
| WO93/15295 | 8/1993 | (WO) | E05B/73/00 |

* cited by examiner

*Primary Examiner*—Suzanne Dino Barrett
(74) *Attorney, Agent, or Firm*—Testa, Hurwitz & THibeault LLP

(57) ABSTRACT

A locking arrangement configured to secure portable equipment includes a tubular lock having a pair of locking arms projecting from a face of the lock body. Each locking arm has a shank portion and a wing portion, the wing portion extending from the end of the shank at a right angle thereto. Each wing has a substantially flat surface. The locking arms are disposed adjacent to one another, and in the unlocked configuration, the wings of both arms are in parallel opposition such that their flat surfaces substantially meet. In the locked configuration, the wings are parallel to each other but extend in opposite directions outside the envelope. This opposite orientation of the wing members prevents the lock from being withdrawn through the locking port. Moreover, if the two shanks are seated within a port whose dimensions closely match those defined by the shanks themselves, rotation of the lock will be substantially prevented.

8 Claims, 5 Drawing Sheets

SECURITY LOCK FOR PORTABLE ARTICLES

FIELD OF THE INVENTION

The present invention relates generally to security devices, and in particular to locks for portable articles such as laptop and notebook computers.

BACKGROUND OF THE INVENTION

Portable electronic devices such as laptop and notebook computers are too large to be worn or carried continuously, yet are readily stolen when momentarily unattended. Accordingly, specialized locking mechanisms have been developed to prevent theft without impairing convenience of use. These frequently involve engagement with a standardized, dedicated locking port or aperture within the body of the equipment. The locking aperture is so located that the equipment may still be operated when secured.

A typical locking arrangement includes a lock and a flexible but sturdy cable emerging from the lock. The cable, which may terminate in a loop, is drawn around a convenient stationary fixture. The lock is passed through the cable loop and then secured to the equipment through the locking port.

For example, U.S. Pat. No. 5,327,752 describes a tubular lock with a key-operated, rotable T-shaped spindle that emerges from an end face of the lock body. The spindle is inserted into the locking port of an item to be protected; the locking port is asymmetric with dimensions slightly larger than those of the spindle head. After the spindle head clears the interior surface of the wall, it may be rotated, using a properly fitting key inserted in the opposite face of the lock. A 90° rotation secures the spindle head behind the interior wall surface.

To prevent the lock from simply being rotated and the spindle removed from the locking port, the tubular lock of the '752 patent contains two additional features. First, a pair of "anti-rotation arms" flanking the spindle are inserted, along with the spindle, into the locking port; forming an off-round configuration, the spindle neck and the flanking arms cannot be rotated within the asymmetric port. Second, the entire lock is urged against the exterior surface of the article to be secured by a spring mechanism. As the spindle and arms are passed through the locking port, the lock is pressed against the article to be secured and the key used to rotate the spindle head into the locked position. The lock is then released, the spring mechanism keeping it biased against the article surface.

This type of lock is disadvantageous both in requiring a spring bias, which reduces the convenience of use while increasing the cost of manufacture, and in the need for an asymmetric locking port.

DESCRIPTION OF THE INVENTION

Objects of the Invention

It is, accordingly, an object of the present invention to provide an improved locking system for portable articles.

A further object of the present invention is to facilitate locking of portable articles without the need for spring loading or other bias against the article.

Another object of the invention is to provide a locking system for portable articles that does not require a specifically shaped locking port.

Other objects will, in part, be obvious and will, in part, appear hereinafter. The invention accordingly, comprises the features of construction, combination of elements and arrangements of parts which will be exemplified in the following detailed description and the scope of the invention will be indicated in the claims.

Brief Summary of the Invention

In accordance with the present invention, a locking arrangement configured to secure portable equipment includes a tubular lock adapted for use with, for example, a looped cable. The lock is generally in the form of a cylindrical body that contains keying and tumbler components, and which is surrounded by a collar. A sleeved steel cable emerges from the collar and terminates in a loop. A circular key, inserted into a recess within one end face of the lock body, operates a pair of locking arms projecting from the opposite face of the body. An elastomeric pad may be affixed to the face of the body that makes contact with the article to be secured, i.e., the face from which the locking arms project.

Each locking arm has a shank portion and a wing portion, the wing portion extending from the end of the shank at a right angle thereto. Each wing has a substantially flat surface. The locking arms are disposed adjacent to one another, and in the unlocked configuration, the wings of both arms are in parallel opposition such that their flat surfaces substantially meet. Each wing is only about half as thick as the shank from which it extends, so that the opposed wings reside within the envelope defined by the outer surfaces of the shanks. As a result, the locking arms can be inserted into a locking port having dimensions approximating those of the envelope.

The locking port is an aperture through the wall of the article to be secured. The length of the shanks is chosen such that the wings clear the interior surface of the article wall as the elastomeric face pad of the lock contacts the exterior surface of the wall. A properly cut key received within the tumbler mechanism may be rotated with respect to the stationary exterior of the tubular body, and rotation of the key causes the locking arms to simultaneously rotate in the same direction. This rotation draws the wings in opposite directions, causing them to separate, and after 90° of rotation the wings are parallel to each other but extend in opposite directions outside the envelope. This opposite orientation of the wing members prevents the lock from being withdrawn through the locking port. Moreover, if the two shanks are seated within a port whose dimensions closely match those defined by the shanks themselves, rotation of the lock will be substantially prevented.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
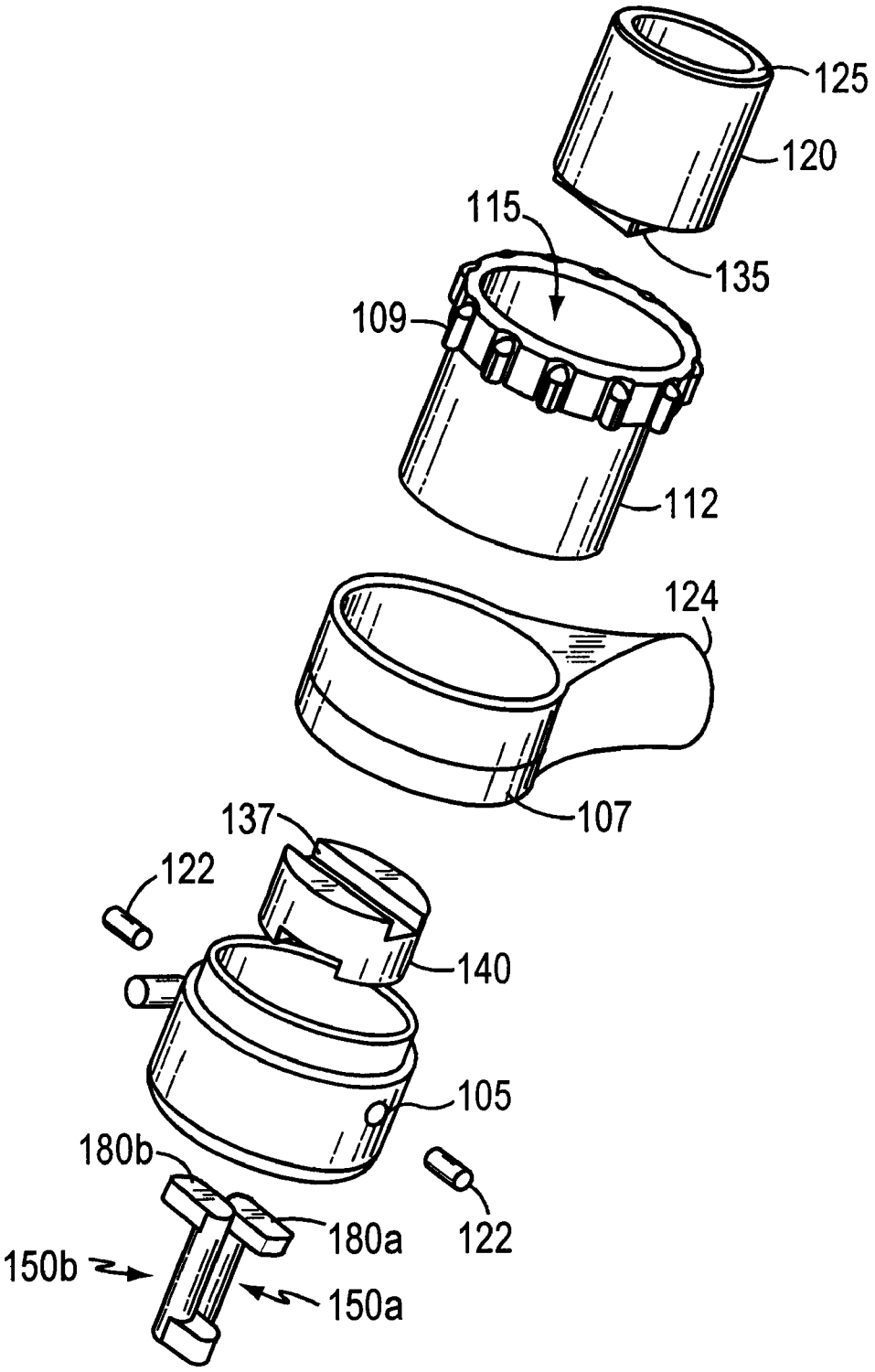
FIG. 1 exploded view of the primary components of the present invention.
Figure 2:
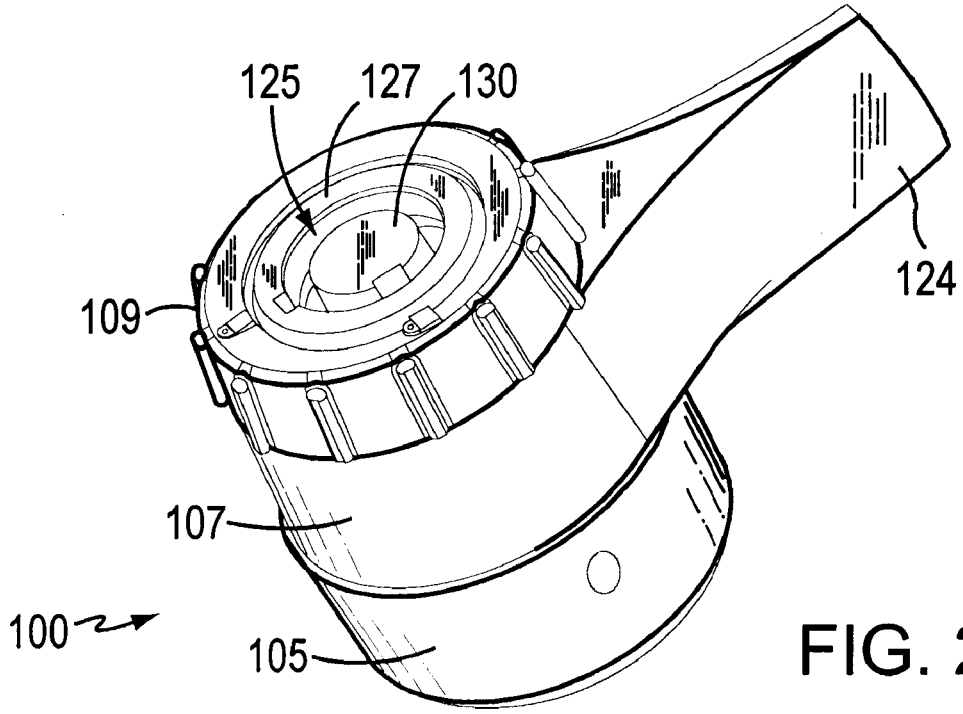
FIG. 2 is an isometric view of the invention showing the face within which a key is received.
Figure 3:
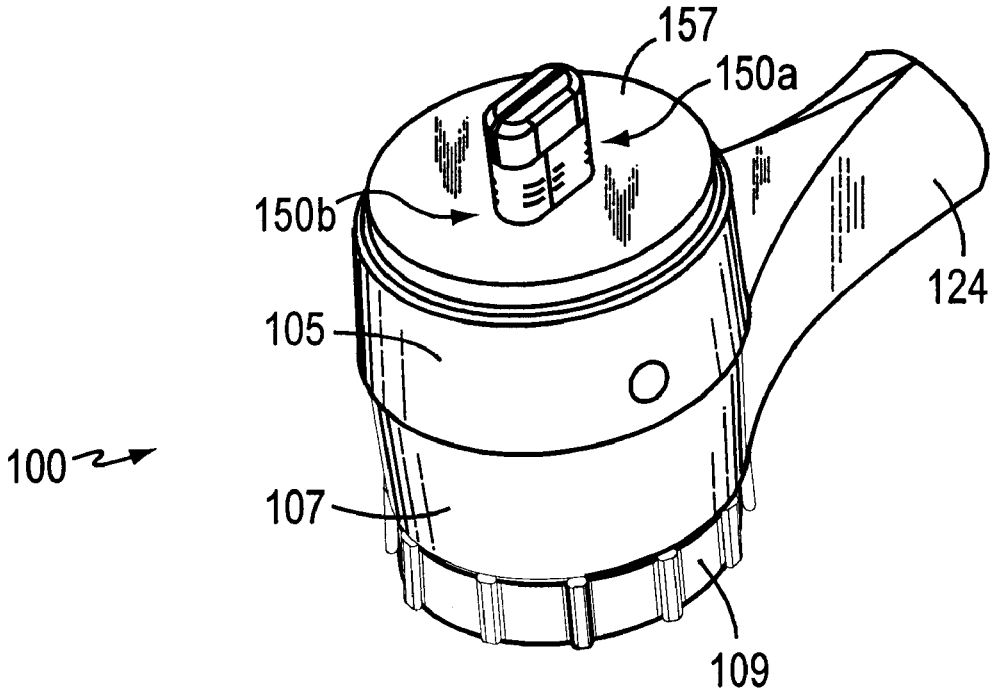
FIG. 3 an isometric view of the invention with the locking arms in the closed or unlocked position.

With reference to FIGS. 1–3, a lock in accordance with the present invention is generally cylindrical in shape and defined in its outer body contour by a case 105, an eyelet ring or collar 107, and the knurled or ribbed flange 109 of a hollow plug 112. Seated within the bore of plug 112 is a lock cylinder 120.

As shown in FIG. 1, collar 107 has a diameter similar to that of plug flange 109, and the outer wall of plug 112 passes through collar 107 until flange 109 rests against the rim of collar 107. The outer wall of plug 112 nests within case 105, and is permanently secured thereto by a pair of pins 122. As a result, plug 112 and case 105 are free to rotate in unison within collar 107. Emanating from the neck 124 of collar 107 is a looped cable (not shown). As is well-known in the art, the cable may be braided stainless-steel and surrounded by a plastic material, such as PVC. Such arrangements are highly tamper-resistant yet do not harm surfaces with which they come into contact.

As shown in FIG. 2, lock cylinder 120 resides fixedly within plug 112 and is secured thereto by a pin (not shown); the front face 125 of lock cylinder 120 is substantially flush with (and securely surrounded by) the top of flange 109. The front cylinder face 125 comprises a notched outer sleeve 127 and a notched inner core 130. Recessed between sleeve 127 and core 130 are a series of tumbler pins (not shown). Normally, these tumbler pins lock core 130 against rotational movement relative to sleeve 127. The recess accommodates a circular key having inner and outer tabs that engage the notches of sleeve 127 and core 130, as well as a series of indentations; by turning ribbed flange 109, the user rotates plug 112 and cylinder 120 until the notches are in a convenient position for alignment with the key. When the key is inserted into face 125 of cylinder 120, the tumbler pins seat within the key indentations and are displaced rearwardly in accordance with the depths of those indentations. A properly cut key has indentations matched to the lengths of the tumbler pins so that, with the key fully inserted, all tumbler pins are displaced to the same plane. Only in this configuration will the key be able to rotate core 130 relative to sleeve 127.

With reference to FIG. 1, the bottom of cylinder 120 has a ridge 135 that seats within a slot 137 of a rotatable cam 140. Cam 140 operates a pair of locking arms 150*a*, 150*b* as discussed in greater detail below, rotating them between an open position and a closed position.

Figure 6:
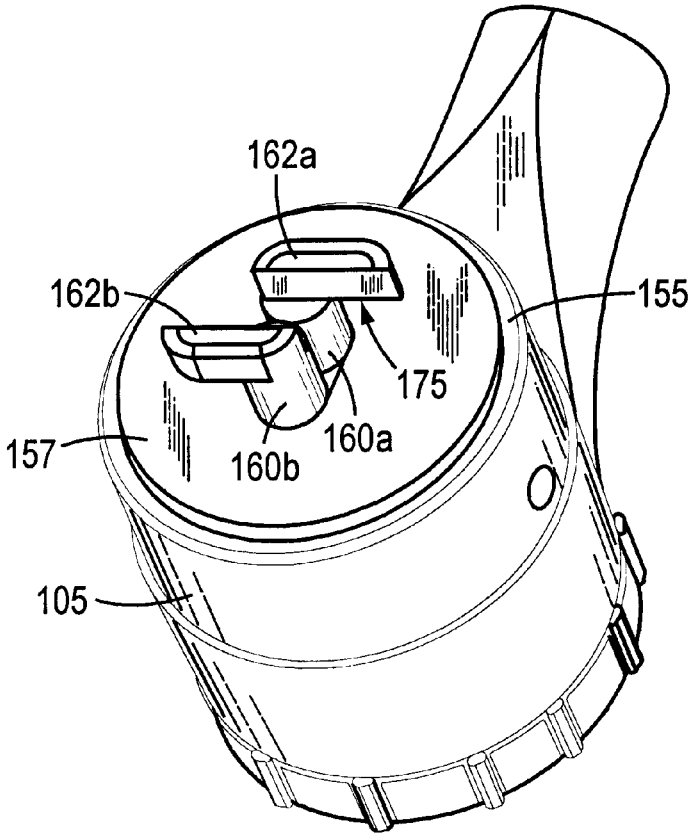
FIG. 6 is an isometric view of the invention with the locking arms in the open or locked position.

As best seen in FIG. 6, which depicts arms 150*a*, 150*b* in the open or locked position, the arms emerge through an aperture in a face plate 105 that caps case 105. Optionally, an elastomeric pad 157 may be affixed (e.g., by means of adhesive) to face plate 105 in order to protect the exterior surface of the article to be locked, in which case arms 150 pass through the elastomeric pad as well. Each arm has a shank portion 160*a*, 160*b*, and a wing portion 162*a*, 162*b* extending from the shank portion at a right angle. In the open position, wing portions 162*a*, 162*b* are substantially parallel but extend in opposite directions. The shanks are disposed closely adjacent each other, preferably spaced about 1 mm apart.

Figure 7:
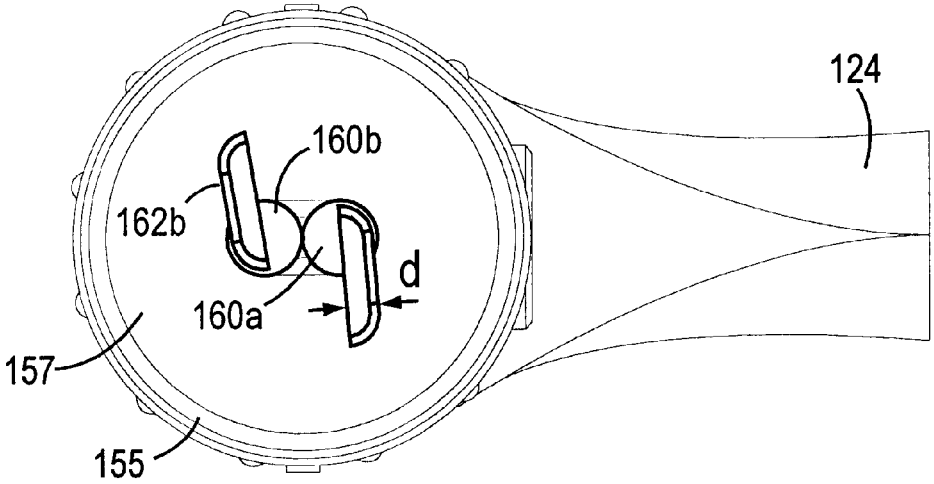
FIG. 7 is a plan view of the invention as depicted in FIG. 5.

With reference to FIG. 7, the wing portions 162 have a flat inner side and a curved outer side, and may be semi-oval or semi-ellipsoid in contour. The thickness d of wings 160 is about half that of the cross-sectional diameter of shanks 162.

Figure 4:
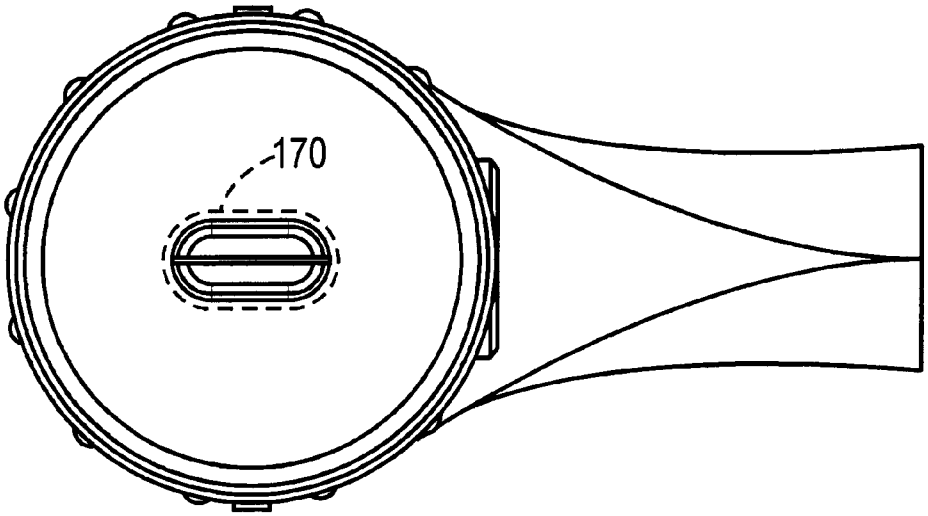
FIG. 4 a plan view of the invention as depicted in FIG. 3.
Figure 5:
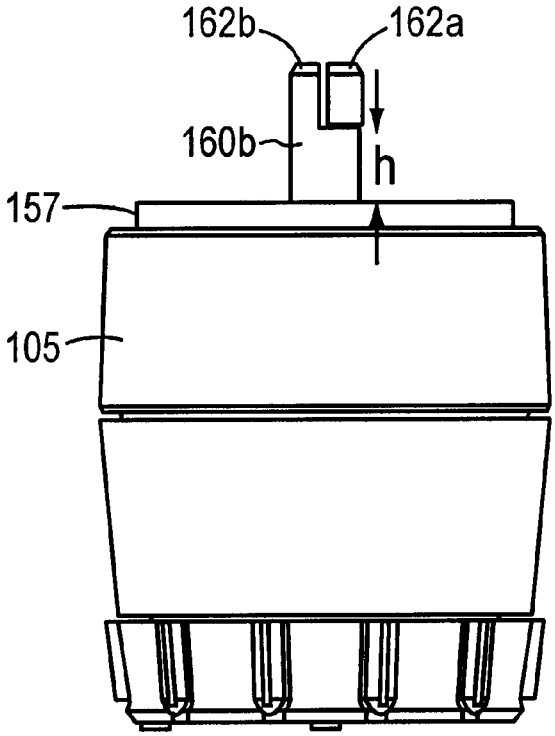
FIG. 5 is an end view of the invention as depicted in FIG. 3.

In the closed or unlocked position, as illustrated in FIGS. 3–5, the wings substantially mate, with their inner flat sides in opposition. Wings 162 thereby form an envelope 170 (see FIG. 4) defined by the contours of outer sides of the wings. The flat edges of wings 162 may, but need not, make contact in the closed position. The locking port of the article to be secured is preferably similar in shape to, but slightly larger than, envelope 170. In this way, the closed locking arms 150 pass easily through the port. Moreover, the height h (see FIG. 5) of the shanks 160 above pad 157 (or, in the absence of a pad, above plate 155) is chosen so that the bottom edges of wings 162—one of which is representatively indicated at 175 in FIG. 6—clear the interior surface of the article wall as face pad 157 contacts the exterior wall surface.

As the key, seated within front face 125, is turned, cam 140 (see FIG. 1) causes locking arms 150 to simultaneously rotate in the same direction, thereby drawing wings 162 into the open position and securing the lock to the article. If the dimensions of the locking port closely match envelope 170, the off-round configuration of the envelope will prevent the lock from being rotated relative to the article. It should be stressed, however, that such rotation—even if permitted—would not defeat the security of the lock, since the open configuration of wings 162 would still prevent them from being withdrawn through the port. Accordingly, it is by no means necessary for the dimensions of the locking port to mirror those of the envelope 170; the locking port may be any shape so long as the wings, when open, cannot pass therethrough.

Figure 8:
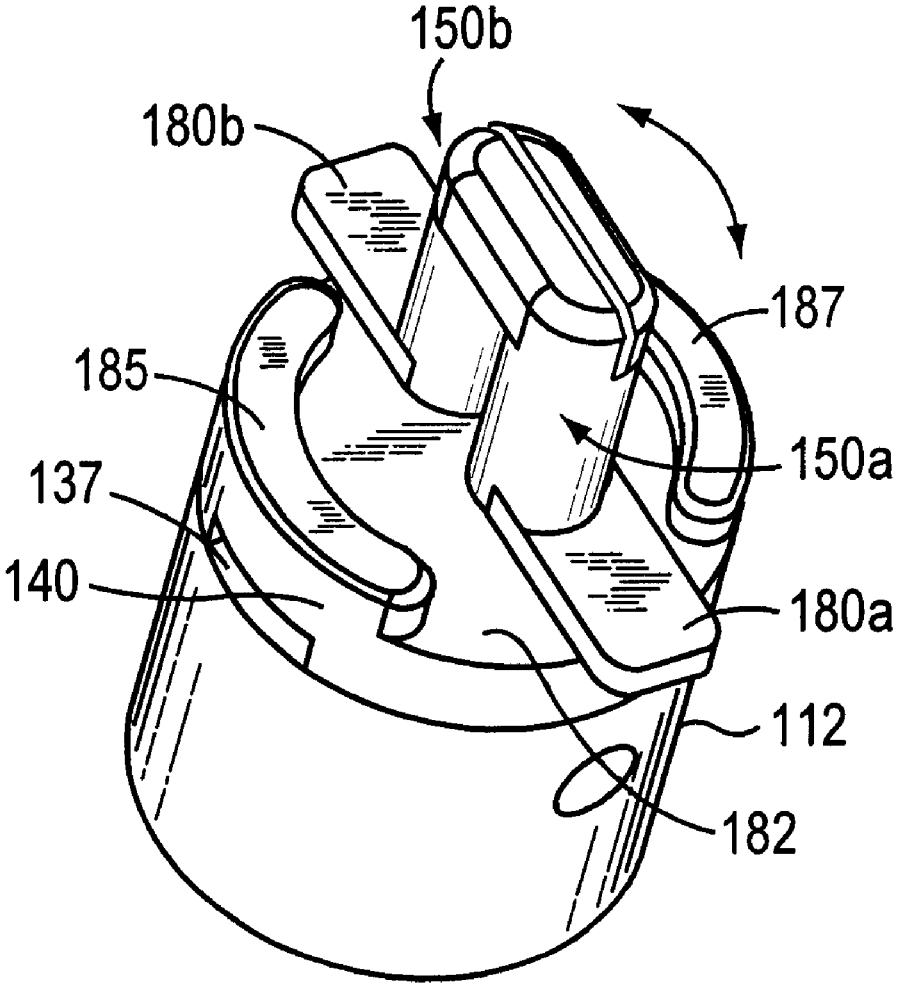
FIG. 8 is an isometric view of some of the interior components of the lock, illustrating the operation of the camming mechanism.

Refer now to FIG. 8, which illustrates the operation of cam 140 in greater detail. Each locking arm 150*a*, 150*b* has a shoulder 180*a*, 180*b* extending from the shank at a right angle, in parallel opposition to the associated wing member. The shoulders 180*a*, 180*b* rest against (or near) the floor 182 of cam 140. Rising from cam floor 182 are a pair of arcuate camming surfaces 185, 187 each having a forward end and a rearward end. Locking arms 150*a*, 150*b* are free to rotate about their axes, but remain otherwise fixed relative to cam 140. As illustrated in the figure, cam 140 has been rotated fully in the clockwise direction. The forward ends of camming surfaces 185, 187 have pushed against shoulders 180*b*, 180*a*, respectively, thereby rotating locking arms 150 into the closed configuration. Subsequent counterclockwise rotation of cam 140 would bring the rearward ends of camming surfaces 185, 187 into contact with shoulders 180*a*, 180*b*, respectively, continued rotation pushing the shoulders and thereby rotating locking arms 150 into the open configuration.

Although the present invention has been described with reference to specific details, it is not intended that such details should be regarded as limitations upon the scope of the invention, except as and to the extent that they are included in the accompanying claims.

What is claimed is:

1. A lock adapted for securing an article having a wall with an aperture therethrough, the lock comprising:

a. a housing having a front end face;

b. projecting from the front end face, a pail of adjacent locking arms, each locking arm comprising a shank portion and a wing portion having a flat surface, each of the locking arms being configured for rotation about the shank whereby:

i. in an unlocked configuration, the wings are disposed in parallel opposition;

ii. in a locked configuration, the wings are parallel but extend in opposite directions; and c. a key-activated locking mechanism for rotating the locking arms into the locked or unlocked configuration.

2. The lock of claim 1 further comprising a looped cable secured to the housing.

3. The lock of claim 1 wherein the lock has a rear end face opposed to the front end face, the key-activated locking mechanism comprising a recess in the rear end face for receiving a circular key, rotation of the received key rotating the locking arms into the locked or unlocked configuration.

4. The lock of claim 1 wherein the wing portions and the shank portions have respective thicknesses, the wing-portion thicknesses being about half the shank-portion thicknesses such that in the unlocked configuration, the opposed wing portions reside within an envelope defined by the shanks.

5. The lock of claim 1 wherein the wall of the article has exterior and interior surfaces, the locking-arm shank portions having a length such that, with the front end face of the housing against the exterior surface of the wall, the locking-arm wing portions clear the interior surface of the wall.

6. The lock of claim 1 further comprising a pad disposed on the front end face, and wherein:

a. the wall of the article has exterior and interior surfaces; and b. the locking-arm shank portions have a length such that, with the pad against the exterior surface of the wall, the locking-arm wing portions clear the interior surface of the wall.

7. The lock of claim 1 wherein the wing portions each have a flat inner side and a curved outer side, the flat sides being in opposition in the unlocked configuration.

8. The lock of claim 1 wherein the key-activated locking mechanism comprises a cam, rotation of which rotates the locking arms into the locked or unlocked configuration.

* * * * *